US005936251A

United States Patent [19]

Gierak et al.

[11] Patent Number: 5,936,251

[45] **Date of Patent: *Aug. 10, 1999**

[54] LIQUID METAL ION SOURCE

[75] Inventors: Jacques Gierak, Villejuif; Gérard Jacques Ben Assayag, St Orens, both of France

[73] Assignee: Centre National de la Recherche Scientifique, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,873

[22] PCT Filed: Jul. 6, 1995

[86] PCT No.: PCT/FR95/00903

§ 371 Date: Apr. 18, 1997

§ 102(e) Date: Apr. 18, 1997

[87] PCT Pub. No.: WO96/02065

PCT Pub. Date: Jan. 25, 1996

[30] Foreign Application Priority Data

Jul. 7, 1994 [FR] France ..... 94 08395

[51] Int. Cl.[6] ..... H01J 27/00

[52] U.S. Cl. ..... 250/423 F; 313/362.1

[58] Field of Search ..... 250/423 R, 423 F, 250/309; 313/362.1

[56] References Cited

U.S. PATENT DOCUMENTS

| | | | |
|---|---|---|---|
| 4,318,030 | 3/1982 | Jergenson | 250/423 F |
| 4,328,667 | 5/1982 | Valentian et al. | 250/423 F |
| 4,551,650 | 11/1985 | Noda et al. | 313/362.1 |
| 4,617,203 | 10/1986 | Jergenson | 427/294 |
| 4,638,210 | 1/1987 | Jergenson | 313/362.1 |
| 4,774,413 | 9/1988 | Okubo et al. | 250/423 F |
| 5,153,440 | 10/1992 | Yasaka | 250/423 F |
| 5,399,865 | 3/1995 | Umemura et al. | 250/423 F |

FOREIGN PATENT DOCUMENTS

| | | |
|---|---|---|
| 0080170 | 6/1983 | European Pat. Off. . |
| 8606210 | 10/1986 | WIPO . |

OTHER PUBLICATIONS

Ishitani et al; "Carbon Needle Emitter for Boron and Aluminum Ion Liquid–Metal–Ion Sources"; May 1982; pp. L277–L278; Japanese Journal of Applied Physics, vol. 21, No. 5.

Bell et al; "The emission characteristics of an aluminum liquid metal ion source"; Jul. 1982; pp. 4602–4605; Journal of Applied Physics, vol. 53, No. 7.

*Primary Examiner*—Bruce C. Anderson
*Attorney, Agent, or Firm*—Hayes, Soloway, Hennessey, Grossman & Hage, P.C.

[57] ABSTRACT

A liquid metal ion source includes a cylindrical rod made of an electrically conductive refractory material, ending in a conical pointed end. The cylindrical rod passes through a reservoir of a liquid supply metal. The length of the rod inserted into the reservoir is in electrical contact with the liquid metal in the reservoir, and the reservoir is in contact with a conductive filament. The cylindrical rod, the reservoir and the conductive filament are electrically connected in series.

21 Claims, 4 Drawing Sheets

LIQUID METAL ION SOURCE

DESCRIPTION

1. Technical Field

This invention relates to the field of liquid metal ion sources, in which ions are produced from a supply metal which covers a point made of a refractory metal.

By applying an intense electrical field, under vacuum, between this point and an extraction electrode, there is emission of ions according to a field evaporation mechanism. This emission is localised at the apex of the point. The size of the emissive area is of the order of a few $nm^2$ for an emission current of about 2 $\mu$A.

These sources are used in focused ion beam machines which play an increasingly important part in the techniques of microelectronic fabrication.

At present, these machines almost exclusively use ion sources of liquid gallium metal. The use of lighter ions is interesting since it allows the size of ionic probes to be reduced. This allows the resolution of existing machines to be increased, by simply changing the source. Furthermore, for implantation applications, a light element is interesting since it penetrates more deeply into the material than a heavy element, at equal energy.

2. State of the Art

The article by Bell et al. that appeared in the "Journal of Applied Physics", Vol. 53, No. 7, July 1982, pp. 4602 to 4605 described a source of aluminium ions made up of a graphite point fixed onto a tungsten heating filament. The graphite point is surface treated by deposition of a film of titanium. In effect, the graphite is relatively resistant to attack by liquid aluminium, but it is difficult to wet it with such a liquid. The use of a film of titanium allows this problem to be resolved. The source has the shape illustrated in FIG. 1, where reference number 2 designates the graphite point, which has, at its base a cylindrical part. A heating filament 4, made of tungsten, passes through this cylindrical part. Heating of the point 2 is obtained by the heat released by a Joule effect in the filament.

This type of source has the advantages, on the one hand of simplicity, and on the other hand, of compactness since the graphite point has a diameter of about 0.8 nm, for a length of 2 mm.

Nevertheless, a certain number of disadvantages are observed with it. Firstly, the assembling and the positioning of the graphite point on a filament whose diameter is less than 0.2 mm are very delicate and indeed uncertain. The assembly lacks mechanical stability, which causes thermal drifting that is incompatible with applications in the field of microelectronics. On the other hand, heating of the emissive area is poorly controlled. The greater the thermal power used by the source, the more the thermal drift due to radiation to the environment is increased. This consequently, can modify the mechanical centring of the emissive point with respect to a target or with respect to an extraction electrode. This centring influences the direction of the emission of the ions and is inaccessible during operation. Its variation leads therefore to a loss of precision; in the context of use in the field of microelectronics, the resolution of the etched structures obtained with such a source is affected to a considerable extent. Another problem is the limited life of the source. In effect, the reserve resolution of the etched structures obtained with such a source is affected to a considerable extent. Another problem is the limited life of the source. In effect, the reserve of liquid supply metal is small and cannot be used in its entirety.

Document WO 86/06210 describes another type of ion source, that includes a point and a heating element in the form of a tape. A hole in the heating tape allows a molten liquid to flow in the direction of the point.

DESCRIPTION OF THE INVENTION

This invention seeks to resolve the problems mentioned above.

The object of the invention is a liquid metal ion source including a cylindrical rod made of a conductive and refractory material, extended by a point made of refractory material, intended to be covered by a liquid supply metal, characterised in that the assembly made up by the cylindrical rod and the point passes through a reservoir made of a conductive material, the area where the rod is inserted into the reservoir ensuring an electrical contact between the rod and the reservoir, and in that the reservoir is in contact with a conductive filament, the cylindrical rod, the reservoir and the conductive filament being thereby connected in series from the electrical point of view.

Such a construction for a liquid metal ion source allows one to limit the input of energy necessary for an optimal operation of the source. In effect, there is only production of heat in a very localised area, limited to the part of the cylindrical rod next to the point, to the reservoir and to the tungsten filament. The most resistive element in the circuit is thus the cylindrical part of the rod, which, when a current of 5 amperes passes through it reaches a temperature of 700° C. adjacent its end by the Joule effect.

According to one particular embodiment of the invention, the rod and the point can be formed as one and the same piece.

For example, the rod and the point can be made of graphite.

According to one further particular embodiment, the graphite point is covered with a film of titanium.

According to one variant, the point is covered with a metal priming coat of the same kind as the liquid metal it is intended to use with the source.

The priming coat can not only cover the point but also a part of the reservoir.

In the case where the liquid metal intended to be used to cover the graphite point is aluminium, a surface treatment of the point allows improvement to the wettability of the point by the liquid aluminium. Two surface treatments are described below, the second has the advantage of allowing one to obtain a very homogeneous film of aluminium over the whole of the point. In effect, the surface treatment of the graphite point by deposition of a film of titanium does not allow one to achieve homogeneous wetting of the point with a film of aluminium: in fact, a formation of small islands of aluminium is obtained on the surface of the graphite point and as a result the function of supplying aluminium to the point is very much disrupted. The current emitted is then unstable and very difficult to keep constant over long periods.

Contrary to this, the second treatment on the one hand improves the function of supplying the metal to be ionised to the apex of the point and, on the other hand, allows the stored quantity of supply metal to be increased. The ion current then obtained from the production of aluminium ions is then accordingly more stable over time.

According to another particular embodiment of the invention, the cylindrical rod and the point are mechanically adjusted with tight clearances to the inside of the area provided for their passage in the reservoir.

This adjustment gives the following advantage. During operation of the source, it is possible that hot spots, other than those situated adjacent the point, appear on the cylindrical rod, on the other side of the reservoir in relation to the point. If a certain clearance exists between the cylindrical rod and the reservoir, the liquid metal goes into it and rises towards these hot spots, from whence it can evaporate, which reduces the life of the source. The adjustment, without any clearance at all of the rod with the inside of the reservoir allows this disadvantage to be remedied.

Other complementary aspects of the invention appear in the dependent claims.

DESCRIPTION OF THE FIGURES

The characteristics and advantages of the invention will become more apparent in the light of the description which will follow. This description is supported by examples given for explanatory purposes and which are non-limitative, and makes reference to appended drawings in which.

DETAILED DESCRIPTION OF EMBODIMENTS OF THE INVENTION

Figure 2:
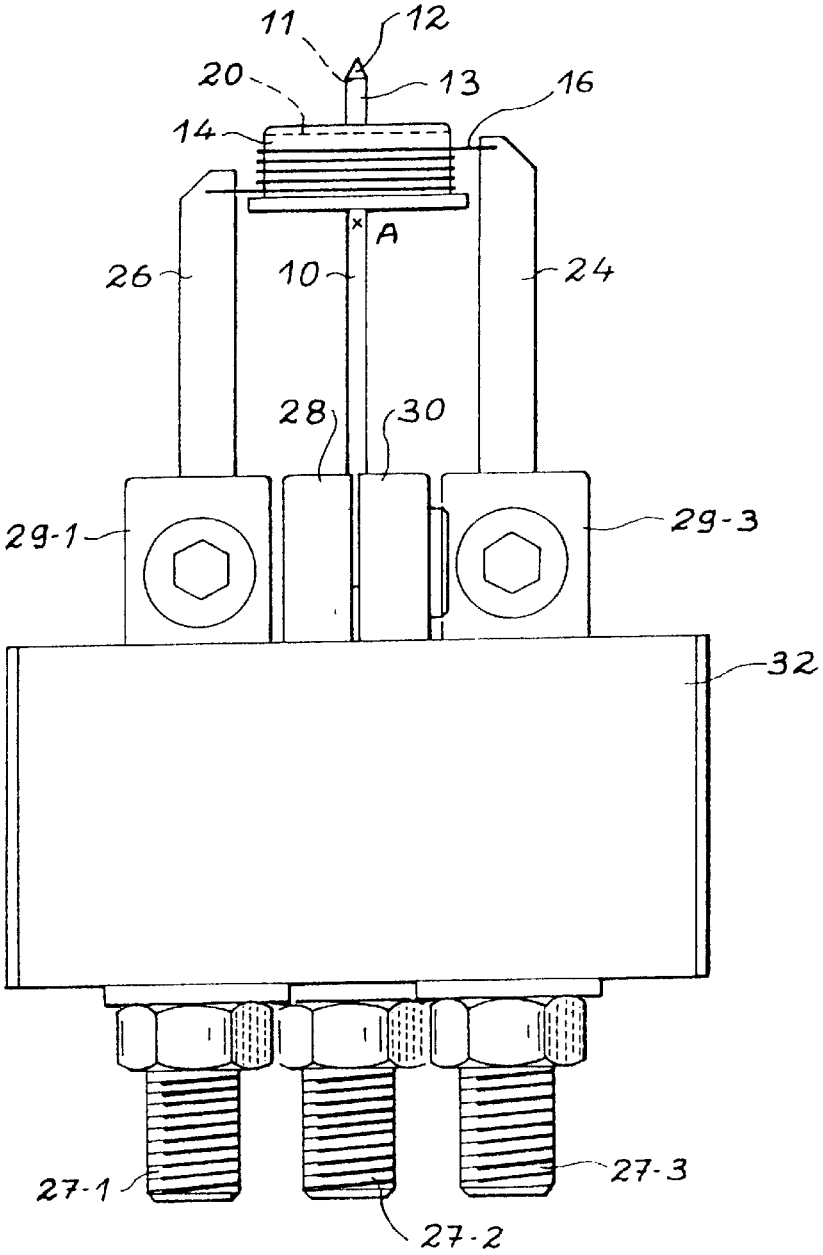
FIG. 2 shows a liquid metal ion source according to this invention.

FIG. 2 illustrates one particular embodiment of a liquid metal ion source according to this invention.

This source is made up of a conducting rod comprising a cylindrical part 10 and a point, the latter being itself made up of a conical part or end 12 and a cylindrical part 13. The cylindrical part 10 is made of a conductive and refractory material. Generally, graphite is suitable within the context of an application with a light metal ion source, such as aluminium. But this does not exclude the use of other materials, such as, for example tungsten. The rod, in its cylindrical part 10, can have, in the case of graphite, a diameter of the order of a few tenths of a millimetre, for example 0.5 mm, and a length of between 5 and 20 mm, for example 15 mm. In fact, in various different embodiment examples, a simple HB pencil lead has been used, which has given complete satisfaction.

The extremity 12 of the point is shaped into a cone, the half angle at the apex having a value between 48 and 50°, for example 49°, by mechanical polishing in two stages. The point is set in rotation, inclined at about 49.5°, and it is brought into contact with a plane which will machine the conical part. In a first stage, the cone is formed on a surface of medium roughness of about 30 $\mu$m. In a second stage, finishing is carried out to a surface of low roughness, for example a few microns.

In this way, at the apex of the point, a radius of curvature is obtained of the order of about ten microns, in a reproducible manner.

The point, that is to say the whole item made up of the cylindrical part 13 and the conical end 12 has a total length of between 5 and 10 mm, the cylindrical part 13 having a length of a few mm (for example 3 mm).

So as to avoid, during operation of the source, a rupture of the film of liquid metal on the edge at the base of the cone, where the cylindrical part begins, it can be of interest to chamfer the area 11 where the cylindrical part 13 joins the conical end 12.

If the point is made of the same material as the cylindrical part 10 of the rod, the whole can be one and the same piece.

Figure 3A:
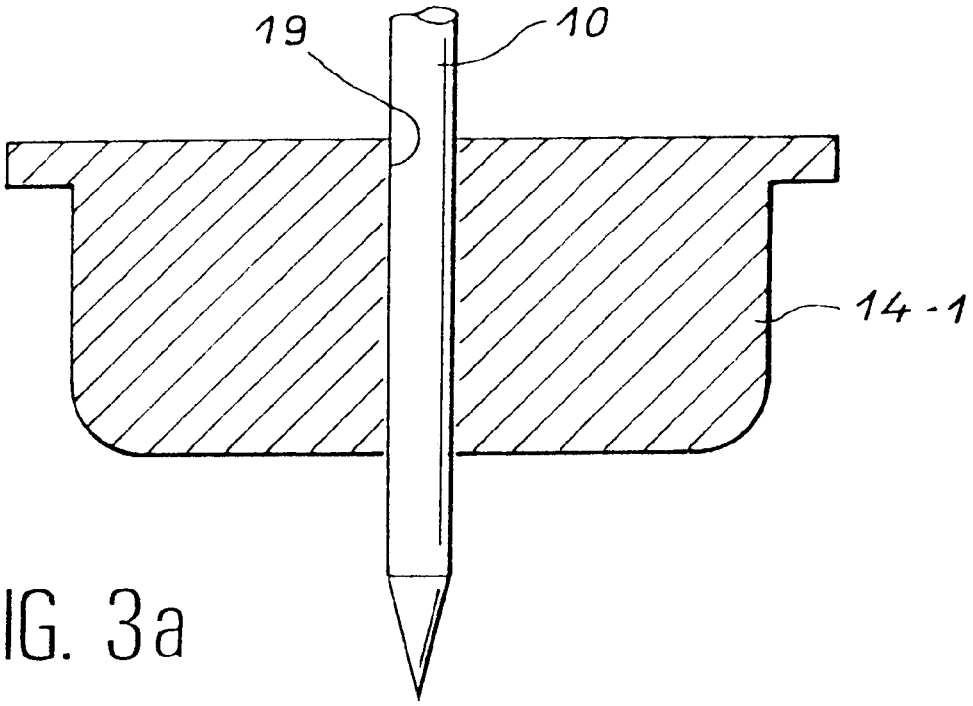
FIGS. 3*a* and 3*b* show two examples of a reservoir used in a liquid metal ion source according to this invention.
Figure 3B:
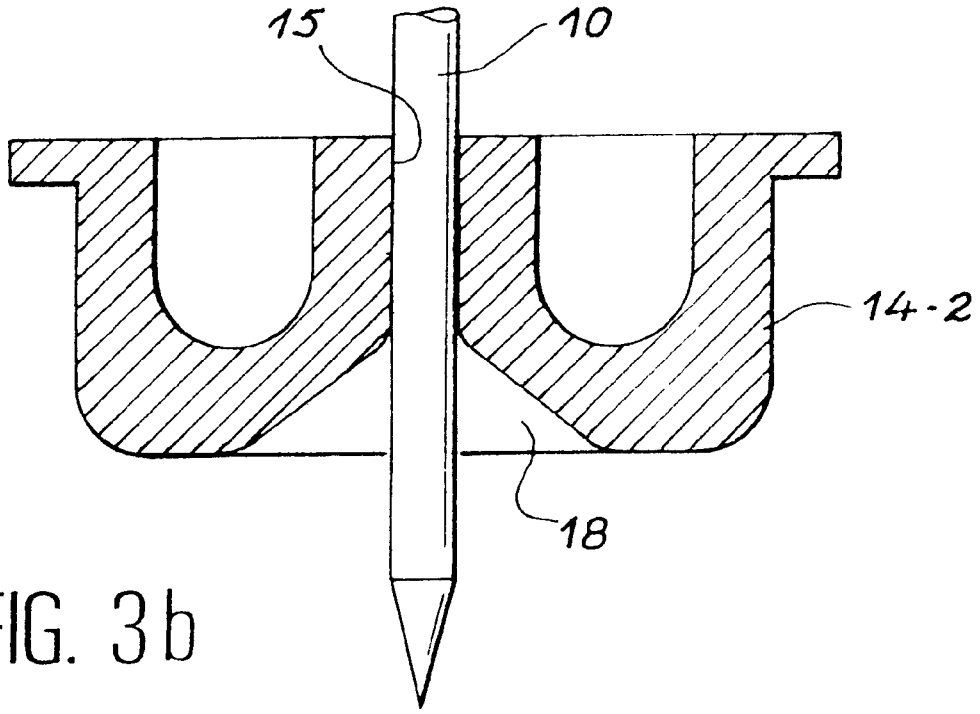

The rod is introduced into a reservoir 14, two examples of which are illustrated in more detail in FIGS. 3*a* and 3*b*. In each of these figures, the reservoir designated by reference numbers 14-1 and 14-2 has a shape substantially having rotational symmetry about an axis passing through 10. In the two examples, a cylindrical opening 19, on the inside of the reservoir, allows passage and also the holding of the rod in a fixed position and contributes to the mechanical stability of the assembly. In the example in FIG. 3*b*, the reservoir 14-2 has a part cutaway in the form of a chamfer. This cutaway has the purpose of allowing the capacity of the reservoir for liquid metal to be increased. An internal void 17 allows the volume of material used for the reservoir to be reduced.

In all cases, the reservoir is made of a conductive and refractory material. If the rod 10 is graphite, it will be enough to select, for example, graphite as the material for the reservoir.

One particularly advantageous form of graphite is vitreous carbon. As opposed to polycrystalline graphite, which has micropores and microfissures, vitreous carbon has an impermeable structure of closed pores.

Over the long term, ageing of the source has been observed. It shows itself by the appearance of graphite powder on the surface of the liquid supply metal, in particular in the case of aluminium.

The grains of this powder are, it would appear, lifted away by the chemical action of the molten aluminium, which penetrates into the micropores and the microfissures of the polycrystalline graphite, even when specifically developed for refractory applications.

Tests carried out with a point and a reservoir made of vitreous carbon have made it possible to observe:

- the absence of carbon particles on the surface of the liquid metal film (aluminium, notably), which leaves one to think that the longevity of the source will be increased,
- a clearly greater resistivity of the point-reservoir assembly, which allows one to decrease the value of the heating current by a factor of 2. This current is therefore reduced to about 2 amperes.

Furthermore, the possibility must be mentioned of electrochemically shaping the end of the vitreous carbon point in order to match the threshold ionic emission value to a specific apparatus.

It is possible to work only with the point or the reservoir made of vitreous carbon.

If only the reservoir is vitreous carbon, it is observed that there is no longer any corrosion of the reservoir. The resistivity is not so good as in the preceding case but better than if the reservoir is made of "normal" graphite.

Similarly, if only the point is vitreous carbon, its life will be prolonged and the resistivity will be improved. Furthermore, the point alone can still be shaped electrochemically.

The rod 10 being used as an electrical conductor, there is, in principle, production of heat in a very localised area, limited to the conical part 12, to the cylindrical part 13 and to the reservoir 14. However, occasionally the formation of "hot spots" cannot be avoided on the cylindrical part 10, and close to the base of the reservoir 14, for example, at a point such as point A shown in FIG. 2. At such a hot spot, the temperature can reach a value greater than that of the temperature at the end of the rod, adjacent the point 12, due to the fact that adjacent this point, the presence of liquid metal contributes to the dissipation of the heat. The liquid metal can have a tendency to diffuse thermally, along the rod, in the direction of the hot spots which has the effect of gradually emptying the reservoir and hence of reducing the endurance of the source. For these reasons, it can be of interest to adjust mechanically the cylindrical part 10 of the rod with tight clearances, without any play, to the inside of the reservoir 14. Consequently, the liquid metal cannot escape along the rod. Furthermore, this reinforces the mechanical strength of the assembly. As an example, a reservoir has been made with a diameter of about 5 mm, for a height of about 2 mm. The cylinder 19 is machined to the nominal diameter of the rod 10 and this is then forcibly introduced by hand. This is sufficient to ensure the required tight fit.

As illustrated in FIG. 2, the reservoir 14 is connected electrically to a heating circuit. This circuit can be made up, for example, of a tungsten filament 16 wound around the base of the reservoir 14, on the opposite side to the point 12. The ends of this filament are themselves connected to conductive elements 24, 26, such as, for example, tantalum plates. According to a variant, not shown in the Figures, the filament 16 is not in contact with the external surface of the reservoir 14, but it is introduced into a throat formed in the surface of this reservoir. This allows one to limit the contact between the heating filament 16 and possible drops of liquid metal that could have diffused along the external surface of the reservoir 14. In effect, certain liquid metals, and notably aluminium, are extremely corrosive with respect to metals.

The rod is held at its base by a clamp made up of two jaws 28, 30 which have the purpose, on the one hand of ensuring that the rod is held mechanically with maximum rigidity without making it brittle and, on the other hand ensuring a reliable electrical contact with the material of this rod, electrical contacts that allow the circulation of a current of about 6 A.

Made up in this way, the heating circuit includes the rod, with its cylindrical part 10 and its point, the reservoir 14 and the filament 16. From the electrical point of view, all of these elements are connected in series and the assembly operates at a floating power supply voltage of the order of a few volts. The most resistive element of the circuit is the cylindrical part of the rod 10 which when a current of 5 A passes through it, reaches a temperature of 700° C. through the Joule effect. Furthermore, the fact that the rod is used as a heating element allows the power consumed to be limited to less than 10 Watts approximately.

The assembly rests on a baseplate 32, with 3 threaded rods 27-1, 27-2, 27-3 passing through it. The central threaded rod 27-2 is extended by the jaws 28, 30; the side rods 27-1 and 27-3 are extended by the fixing jaws 29-1 and 29-2 for the plates 26 and 24. All these elements (jaws, threaded rods) are part of the electrical circuit.

The structure which has just been described confers very good mechanical stability on the assembly, and notably to the point 12. This allows the emissive area at the apex of the point to be stabilised and makes the source compatible with use in technical fields where the precision required is extremely high, for example in electrostatic optics. Furthermore, from the point of view of the space it occupies, the source described is totally compatible with the machines and systems that already exist to which liquid metal ion sources are fitted.

Figure 4:
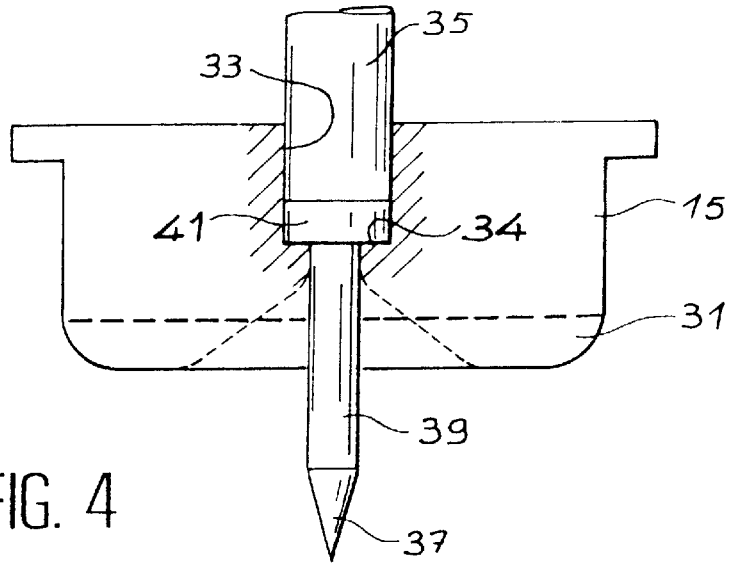
FIG. 4 shows an embodiment of a rod for a source according to the invention.

Another embodiment of the rod is shown in FIG. 4. In this Figure, the rod passes through the reservoir 15. The latter is similar to that described above in connection with FIG. 3*b*, except for the cylindrical opening 33 which has a diameter larger in its upper part than in its lower part, thereby defining a shoulder 34.

The rod is still made up of a cylindrical part 35. It is extended by a point which is itself made up of a conical part 37, a cylindrical part 39 and an edge 41. The rod 35 is of a diameter substantially greater than that in the first embodiment of the rod. The cylindrical part 39 and the extremity 37 of the point have approximately the same dimensions as previously.

In this embodiment, the cylindrical part and the point are made of two different materials.

The rod is made of a conductive and refractory material, for example, graphite. As in the first embodiment, it can be made from a pencil lead. It is introduced into part of the depth of the cylindrical opening 33, in such a way that it is in contact with the point.

The point is made of a refractory material such as boron nitride or alumina. It is introduced in such a way that the edge 41 rests on the shoulder 34 and it is in contact with the end of the cylindrical part 35.

The point 37 is shaped with a half-angle at the apex of between 48 and 50° (with a value for example of 49°) by mechanical polishing using an abrasive such as, for example, a diamond grinding wheel.

This second embodiment can also be used in combination with a reservoir of a shape similar to that described in connection with FIG. 3*a*, with the condition that the cylindrical opening is adapted in a corresponding manner (opening of the cylinder larger in its upper part than in its lower part). What has been said in the context of the first embodiment about the mechanical adjustment with tight clearances also applies to this second embodiment.

The operation of the source is the same; there is still electrical contact between the rod 35 and the reservoir 15 and the current flows from the rod to the reservoir and to the heating filament. This current causes heating of the point through the Joule effect.

Whatever the shape of the rod, and so as to improve the wettability of the point 12 and of the reservoir by the liquid supply metal, it is of interest to carry out a surface treatment of this point and of the reservoir. First, the surfaces to be treated may have been cleaned in a bath of boiling trichlorethylene, then degassed by heating under vacuum at a temperature of about 1000° C.

A surface treatment has been described in the article by Bell et al. already mentioned above. This treatment consists of laying down an aqueous solution of titanium powder on the point. After drying, the point is brought, under vacuum, to a temperature of about 1700° C. to melt the titanium. This treatment is compatible with the structure of the source according to this invention, such as described above.

A variant of this surface treatment consists of depositing the film of titanium by spraying before bringing it, under vacuum, to a temperature of about 1700° C. to melt it. In the case of the use of the source with liquid aluminium, it has been observed that, with this surface treatment, a clearly improved homogeneity of the aluminium film is obtained compared with that obtained in the case where the surface is treated by the process described above. This allows one to have a good supply to the apex of the point and hence a more stable ion current over time.

Figure 5:
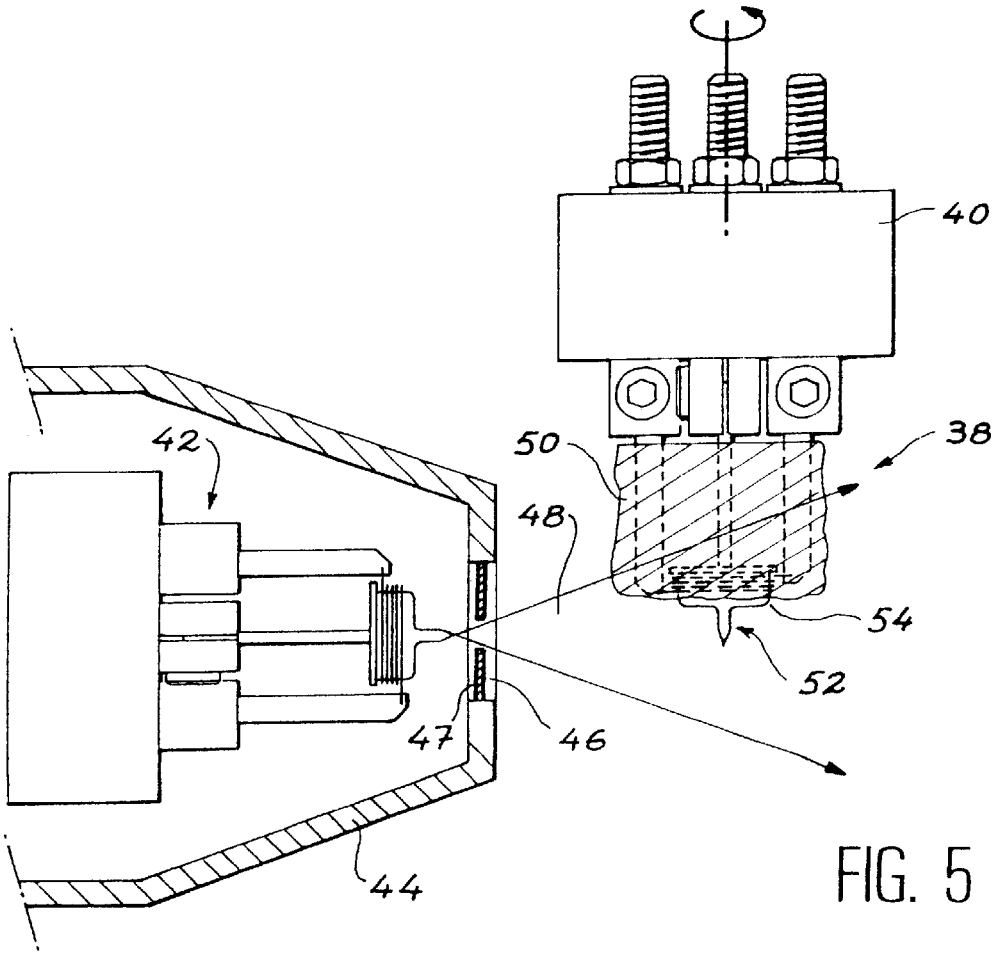
FIG. 5 shows the treatment device used to prepare a liquid metal ion source according to this invention, FIGS. 6 and 7 give examples of results obtained with an ion source according to this invention.

A third method of treating the surfaces that can be used in the context of this invention, consists of irradiating with a beam of ions the point and the reservoir designed to receive the liquid supply metal. In the case where the source is intended to be used with liquid aluminium, the beam of ions is a beam of aluminium ions. The irradiation is carried out within an enclosure under vacuum. FIG. 5 shows schematically the implementation of the irradiation process. The source whose extremity must be irradiated is shown on the right of the Figure, in a vertical position, held by a support 40, which can pivot about a vertical axis, and which can also be displaced in translation along the three perpendicular directions of the space. So as to carry out the desired irradiation of the extremity of the source 38, another source of ions 42 must be made available. This source can either be a source identical to that which is sought to be produced and to which a similar treatment has already been applied, or a source such as that described in the prior art, for example, in the article by Bell et al. already mentioned above. An extraction electrode 44, permits the acceleration of the ions formed by the source 42 in the form of a beam 48 which passes through a window made in the electrode 44. This window includes an extraction diaphragm 47. In order to regulate the extraction current of the source 42, the emitting point is held at a variable high voltage, of about 10–12 kV. The assembly formed by the extraction electrode 44 and the source 42 can be oriented in space according to three perpendicular directions. In general, the beam of ions 48 has a conical shape, such as that shown in FIG. 4, and it is along the central axis of this beam that the maximum current is apportioned. Therefore, it is of interest to position the source 42 in such a way that the part of the source 38 to be irradiated is approximately on the central axis of the ion beam 48. The dose of ions received by the source 38 during the treatment corresponds roughly to a surface dose of $10^{18}$ ions/cm$^2$, that is to say to an irradiation with a current of 2 $\mu$A for 1 hour. The acceleration voltage applied to the aluminium ions formed by the source 42 can vary between a few kilovolts and 20 kilovolts; it can, for example, have a value of about 12 kilovolts.

The surface treatment is mainly carried out in two stages:

1. an etching stage, during which the source 42 emits a current of a few microamperes, between 5 and 10 $\mu$A, that is regulated by adjusting the high voltage at which the emitting point of the source 42 is held. In fact the upper limit value of this current can be chosen in such a way that, in the first stage, there is essentially the emission of simple $Al^+$ ions, and practically no emission of $Al^+_n$ aggregates. With an acceleration voltage between the emitting point and the extraction electrode 44, of about ten kilovolts, the aluminium $Al^+$ ions are going to:
   - etch the surfaces of the source 38 which are exposed to their path (the point 52 and the end of the reservoir 54),
   - form a layer on the etched surface, which will be used as a priming coat for the aggregates which will be deposited during the second stage,
2. in a second stage, one causes a greater current to be beamed to the source, a current sufficient to form a beam of metal aggregates of the $Al_n^+$ type in the case of aluminium. In general, a current of value greater than 50 $\mu$A is sufficient to form these aggregates. These aggregates are going to be deposited onto the layer of metal ions laid down in the first stage onto the treated surface and which are playing the role of a priming coat. This layer of metal aggregates itself forms a priming coat for the liquid metal which must subsequently be deposited on the end of the source.

The duration of each of the two stages described above depends on the current used in each stage. With a current of a few microamperes, the first stage has a duration of about 20 minutes; for a current of about 50 $\mu$A, the second stage takes a period of about 40 minutes.

It is possible to add to these two stages a stage of implanting ions and metal aggregates already deposited on the surface treated in the first two stages. During this implantation stage, the source 42 emits a current of a few microamperes, in such a way that a beam, principally made up of simple ions with few aggregates, is emitted. These ions are accelerated by a maximum voltage (of the order of 20 kilovolts) in such a way that the aggregates deposited during the second stage are "driven into" the superficial part of the area which has been treated during the preceding stages.

In order to limit the surface treatment to the point 52 and the front part of the reservoir 54 (the part with reference numbers 20 and 31 in FIGS. 2 and 4 and which is outlined in these same Figures by a dotted line), it is possible to interpose a protective foil 50, such as, for example, aluminium foil, between the beam 48 and the parts of the source 38 that one does not want to irradiate. This can be important, in the case where the liquid metal with which the source is intended to be used can have corrosive effects on the metal parts of the source. This is notably the case with aluminium which, in the liquid state, can easily corrode the parts of the heating system for the reservoir and the point which are external, notably the tungsten filament (see FIG. 2). If, as a consequence, a priming coat made up of metal aggregates is deposited on these parts during the irradiation, the liquid metal will have a tendency, during use of the source prepared in this way, to adhere equally well to these parts, which will bring about rapid corrosion of the metallic elements adjacent to these parts. It is for this reason, notably in the case of aluminium, that the irradiation of the source is limited to the point and the front part of the reservoir and to the walls of the open compartment 18 in the reservoir (see FIG. 3*b*). After having been subjected to this treatment, the source is ready for use. It is immersed, for example, in a bath of liquid aluminium which will wet the irradiated parts and, by capillarity, cover them with a perfectly homogenous and uniform thin film. This very good homogeneity, on the one hand encourages the supply of ionised metal to the apex of the point and, on the other hand, allows one to maximise the quantity of stored supply metal.

Figure 1:
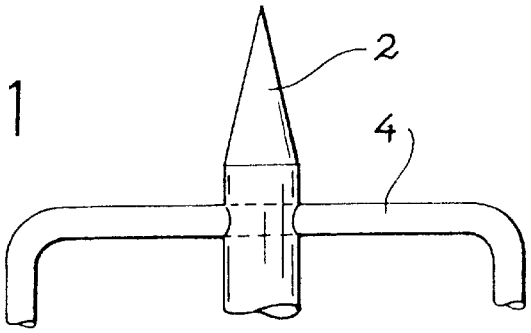
FIG. 1, already described, shows a liquid metal ion source according to the prior art.

This third treatment, applicable to a source having a structure according to the invention can also be applicable to a source having the structure described in the article by Bell et al. and illustrated in FIG. 1. In this case, it is sufficient to subject the graphite point 2 to an irradiation with, for example, a beam of aluminium ions ($Al^+$ then $Al_n^+$). The wettability of the graphite is improved compared with the treatment proposed by Bell et al. in the article mentioned previously, since the latter leads to the formation of small islands of aluminium on the surface of the graphite point.

The invention has been described in the context of the creation of a source of aluminium ions. The choice of this element is not limitative and the same structure and the same surface treatment can be used for any source of ions of another kind, for example, for a boron source. The surface treatment will then consist of irradiating the source with a beam of boron ions, firstly $B^+$ ions and then $B_n^+$ aggregates. Boron is similarly a corrosive element in the liquid state like aluminium and it is therefore preferable to limit the surface treatment to the graphite point 12 and the "front" part of the reservoir 14.

The structure of the source according to this invention can equally well be used for the production of ions from other elements, notably elements noncorrosive in the liquid state.

After preparation and once the source is wetted by the liquid metal, the production of ions from it is carried out using an extraction electrode, mounted in front of the point, in the same way as the electrode 44 is mounted in front of source 42 in the assembly in FIG. 5.

The beam obtained can be more or less rich in metal aggregates of variable size. In fact this choice depends on the voltage applied to the point. For this reason, the source assembly is held at a high voltage of about 11 kV, the supplementary high voltage supply being connected to the base of the rod 10 (using jaws 28, 30 in the representation shown in FIG. 2). The modulation of the high voltage leads to a modulation of the current emitted by the point, this current, in its turn, modulating the distribution of the size of aggregates emitted. As for the potential difference between the point and the extraction electrode, this modulates the kinetic energy of the ions or aggregates emitted.

The main applications of the source according to this invention are:

on the one hand the manufacturing of focused ion beam machines on the other hand, the use of such machines in the field of microelectronics and for the preparation of samples for viewing by transmission microscopy (TEM).

The principle consists then of using the interaction between a beam of very energetic ions, focused on a spot of less than 0.1 micron, and a sample.

The incident ions are going to pulverise the surface of the sample locally on the spot corresponding to the impact area.

The erosion process is controlled along X, Y axes parallel to the surface of the sample by sweeping this surface with the beam, and the depth of this etching by displacing the machine along a z axis perpendicular to the surface. Structures having sizes of the order of 70 to 80 nanometers can be developed with an apparatus incorporating a source according to this invention.

Figure 6:
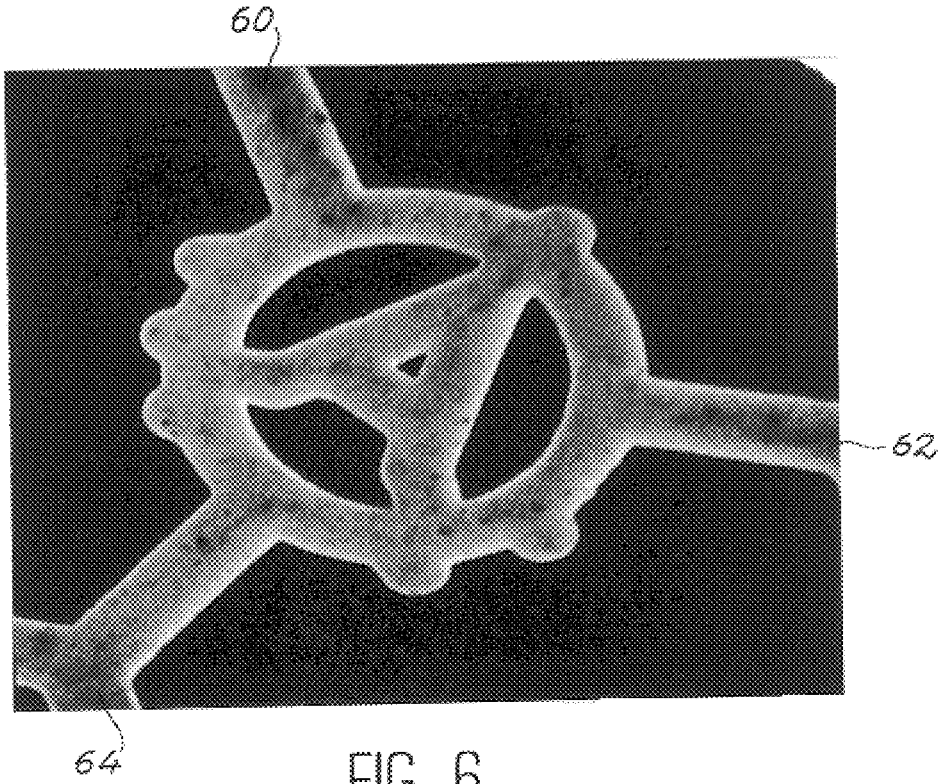
Figure 7:
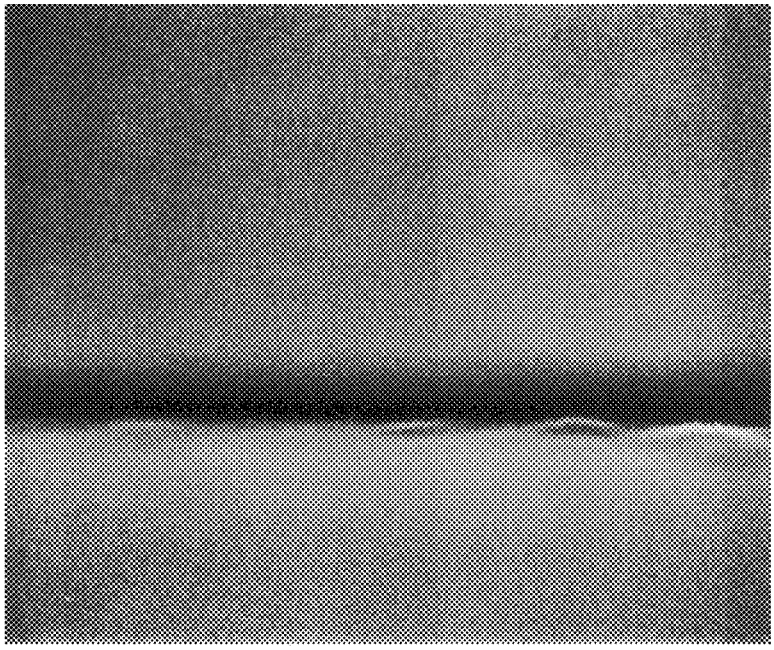

Examples of results obtained with an aluminium ion source designed according to this invention are given in FIGS. 6 and 7. The source used incorporated a surface treatment with a priming coat of aluminium as described above.

FIG. 6 is a photograph of a copper grid taken using an electron microscope in which the electron gun of the microscope has been replaced by the source of aluminium ions. The acceleration voltage of the ions was 12.5 keV, and the emission current was 16 $\mu$A. The wires 60, 62, 64 of the grid have a thickness of about 25 $\mu$m. To create such a shot, the grid had to be irradiated with a very stable beam of $Al^+$ ions for about 1 minute 30 seconds. Hence, this photograph shows the very good stability, over time, of the current and of the beam from the source according to the invention. FIG. 7 is a photograph of an etching carried out on GaAs by a beam of $Al^+$ ions of 20 kev energy (current $i \approx 11$ $\mu$A). In this photo, 1 cm represents 100 nm.

We claim:

1. A liquid metal ion source including a reservoir made of an electrically conductive material for holding a supply of the source metal in liquid state, a cylindrical rod, made of an electrically conductive refractory material, having a conical pointed end, a portion of the rod extending through an aperture in the reservoir in contact with the supply of metal in liquid state, and an electrically conductive filament in electrical contact with the reservoir, wherein the cylindrical rod, the reservoir and the conductive filament are electrically connected in series so as to constitute a heating circuit for said liquid metal when a current passes through it, the most resistive element of said heating circuit being the cylindrical rod, and the portion of the rod extending through the aperture in the reservoir has a tight clearance with the walls defining the aperture in the reservoir.

2. A liquid metal ion source according to claim 1, wherein the reservoir is formed of an electrically conductive refractory material.

3. A process for preparing a sample using a liquid metal ion source comprising a reservoir made of an electrically conductive material for holding a supply of the source metal in the liquid state, a cylindrical rod, made of an electrically conductive refractory material, having a conical pointed end, a portion of the rod extending through an aperture in the reservoir in contact with the supply of metal in liquid state, and an electrically conductive filament in electrical contact with the reservoir, wherein the cylindrical rod, the reservoir and the conductive filament are electrically connected in series so as to constitute a heating circuit for said liquid metal when a current passes through it, the most resistive element of said heating circuit being the cylindrical rod, and a beam of metal ion is produced using said source and directed onto the sample.

4. A process according to claim 3, wherein the rod and the point are adjusted mechanically with tight clearances to the inside of the area provided for their passage in the reservoir.

5. A liquid metal ion source comprising:

a reservoir made of an electrically conductive material for holding a supply of the source metal in the liquid state, a cylindrical rod, made of an electrically conductive refractory material, having a conical pointed end, a portion of the rod extending through an aperture in the reservoir in contact with the supply of metal in liquid state, and an electrically conductive filament in electrical contact with the reservoir, wherein the cylindrical rod, the reservoir and the conductive filament are electrically conductive filament in electrical contact with the reservoir, wherein the cylindrical rod, the reservoir and the conductive filament are electrically connected in series so as to constitute a heating circuit for said liquid metal when a current passes through it, the most resistive element of said heating circuit being the cylindrical rod.

6. A liquid metal ion source according to claim 5, wherein the conductive material from which the reservoir is formed comprises a refractory material.

7. A liquid metal ion source according to claim 5, wherein the rod and the point are formed of one and the same piece.

8. A liquid metal ion source according to claim 7, wherein the rod and the point are formed of graphite.

9. A liquid metal ion source according to claim 8, wherein the point is covered with a film of titanium.

10. A liquid metal ion source according to claim 5, wherein the rod and the point are formed of different materials.

11. A liquid metal ion source according to claim 10, wherein the rod is formed of graphite.

12. A liquid metal ion source according to claim 10, wherein the point is formed of alumina or boron nitride.

13. A liquid metal ion source according to claim 5, wherein the point is covered with a metallic priming coat, which metal is the same as the liquid supply metal.

14. A liquid metal ion source according to claim 13, wherein the priming coat covers the point, and a part of the reservoir.

15. A liquid metal ion source according to claim 13, wherein the priming coat is formed by ionic bombardment.

16. A liquid metal ion source according to claim 15, wherein the ionic bombardment is carried out in two stages:

an etching stage, during which a beam of ions containing essentially no aggregates is directed onto the parts to be irradiated from an ion source, and a second stage, during which a beam of ions comprising essentially metallic aggregates is directed onto the parts to be irradiated from the ion source.

17. A liquid metal ion source according to claim 16, and further comprising an implantation stage, the parts of the source to be irradiated being bombarded by a beam comprising mainly ions accelerated under a high voltage, and few aggregates.

18. A liquid metal ion source according to claim 5, wherein the point is formed of vitreous carbon.

19. A liquid metal ion source according to claim 5, wherein the reservoir is formed of vitreous carbon.

20. A liquid metal ion source according to claim 5, wherein the reservoir has a cutaway hollow.

21. A liquid metal ion source according to claim 5, wherein the heating filament is introduced into a throat at the periphery of the reservoir.

* * * * *